US008118078B2

(12) United States Patent
Freedland

(10) Patent No.: US 8,118,078 B2
(45) Date of Patent: Feb. 21, 2012

(54) HOOK FOR SUSPENDING A CURTAIN AND A CURTAIN WITH INTEGRATED HOOKS

(76) Inventor: David Freedland, Beach Haven, NJ (US)

( * ) Notice: Subject to any disclaimer, the term of this patent is extended or adjusted under 35 U.S.C. 154(b) by 148 days.

(21) Appl. No.: 12/456,662

(22) Filed: Jun. 19, 2009

(65) Prior Publication Data

US 2010/0319858 A1 Dec. 23, 2010

(51) Int. Cl.
*A47H 13/04* (2006.01)

(52) U.S. Cl. ..... 160/330; 16/87.2

(58) Field of Classification Search ..... 160/330, 160/348, DIG. 6; 16/87.2
See application file for complete search history.

(56) References Cited

U.S. PATENT DOCUMENTS 2,652,586 A * 9/1953 Ramsberger ..... 16/87.2
2,831,538 A * 4/1958 Lishman ..... 160/330
2,855,040 A * 10/1958 Gaines ..... 160/330
2,884,053 A * 4/1959 Truesdale ..... 160/330
3,148,726 A * 9/1964 Rothbart ..... 160/390
3,209,966 A * 10/1965 Wach ..... 223/93
4,031,943 A * 6/1977 Silvestre ..... 160/330
5,111,868 A * 5/1992 Sawaya ..... 160/330
5,186,232 A * 2/1993 Zahner ..... 160/330
6,189,597 B1 * 2/2001 Cheng ..... 160/383
6,494,248 B1 * 12/2002 Zahner ..... 160/330
6,530,120 B2 * 3/2003 Samelson ..... 16/87.2

* cited by examiner

*Primary Examiner* — David Purol
(74) *Attorney, Agent, or Firm* — Francis C. Hand; Carella, Byrne et al.

(57) ABSTRACT

The curtain is provided with integrated hooks for suspending the curtain from a curtain rod. Each hook is made of two parts that are secured together to sandwich a top margin of the curtain therebetween. Each hook has a rectilinear base and a curvilinear section that has a terminal section that defines a gap with the base and a portion extending angularly from the base. In one embodiment, the curvilinear section of the hook 10 is resiliently pliable in order to move laterally for passage over the curtain rod.

18 Claims, 4 Drawing Sheets

HOOK FOR SUSPENDING A CURTAIN AND A CURTAIN WITH INTEGRATED HOOKS

This invention relates to hook for suspending a curtain. More particularly, this invention relates to a curtain with a plurality of integrated hooks for suspending the curtain.

As is known, various types of curtains have been suspended from various types of mounting rods. For example, in the case of shower curtains, a top margin of the curtain has been provided with a series of holes, each surrounded by a grommet, for example of metal, and use has been made of individual mounting rings that are split so that each ring may be threaded through a grommet in the top margin of the curtain and then passed over and around a shower curtain rod. Typically, this type of support ring has a pair of terminal ends that can be spread apart to pass over a curtain rod and then snapped together in order to secure the ring about the rod. Because of the nature of the snap fit arrangement of these mounting rings, the task of removing a shower curtain from a support rod, for example for replacement or for purposes of cleaning, has been a tedious time consuming task. Likewise, the replacement of a cleaned shower curtain or a new shower curtain has also been tedious and time consuming.

Other types of mounting hooks and arrangements have been known that incorporate a mounting hook, or the like, in the top margin of a shower curtain so that the shower curtain may be directly mounted onto a support rod. Examples of such constructions are described in U.S. Pat. Nos. 5,186,232; 6,189,597 and 6,494,248.

It is an object of this invention to reduce the time and effort required to mount a shower curtain on a curtain rod.

It is another object of the invention to provide a hook for suspending a curtain, such as a shower curtain, that is easy to manipulate and to mount onto and to be removed from a mounting rod, such as a shower curtain rod.

It is another object of the invention to integrate a series of hooks into the top margin of a shower curtain that permits the shower curtain to be mounted on a shower curtain rod in a quick and easy manner and to be removed from the shower curtain rod in a quick and easy manner.

Briefly, the invention provides a hook for suspending a curtain, such as a shower curtain, from a mounting rod, such as a shower curtain rod, that is integrated into the curtain.

In one embodiment, the hook has a pliable terminal section that can be resiliently deformed to create a gap for fitting over the mounting rod to mount the hook in place and to allow removal of the hook when desired.

The hook is formed of a pair of skeletal plastic bodies that are secured together in side-by-side relation to sandwich a top margin of the curtain therebetween. In this respect, the hook is permanently integrated into the curtain. However, the two skeletal bodies may be formed to be releasable from each other should a need arise to separate the hook from the shower curtain.

The two bodies of the hook are of identical construction and each includes a rectilinear base, a first portion that extends angularly from one end of the base, a second portion that extends from an opposite end of the base and has a terminal section at one end thereof disposed in spaced relation to the first portion and the base to define a gap therebetween. When the two bodies are joined together, the terminal sections of the two bodies form the pliable terminal section of the hook that is to pass about a mounting rod.

Preferably, one of the pair of skeletal plastic bodies has a plurality of spaced apart posts integrally mounted thereon and the other of the pair of skeletal plastic bodies has a plurality of openings. In this embodiment, each opening receives a respective one of the posts in an integral manner.

The second portion of each skeletal body is shaped to accommodate the mounting rod onto which the hook is to be mounted. For example, where the mounting rod is of circular cross-section, the second portion has a curvilinear section that extends to the terminal section. Where the mounting rod is of a square or rectangular or polygonal cross-section, the second portion of each skeletal body is formed of a plurality of rectilinear sections to pass about the mounting rod.

The second portion of each body is resiliently pliable to allow the terminal section of the hook to be moved laterally of the base and first portion for passage over a mounting rod. In this respect, the hook is made of a suitable plastic material such as, polypropylene, k-resin, nylon or other moldable flexible plastics and each half of the hook is of a suitable thickness, e.g. approximately 3/16" and up, to be pliable.

The curtain is made with a top margin that includes a plurality of longitudinally spaced apart recesses, each of which is to receive a hook. In addition, the curtain may have a plurality of holes, each of which is sized for the passage of a post of a hook during fabrication.

In one embodiment, each hook is disposed in a recess of the curtain in upstanding relation relative to curtain with the base of the hook disposed in parallel to the top margin of the curtain.

In another embodiment, each hook is disposed in a recess of the curtain within the plane of the top margin of the curtain with the base of the hook disposed angularly of the top margin of the curtain.

In another embodiment, the hook is rigid with the terminal section and first portion of each said hook defining a gap larger than a mounting rod for passage thereover.

These and other objects and advantages of the invention will become more apparent from the following detailed description taken in conjunction with the accompanying drawings wherein.

Figure 1:
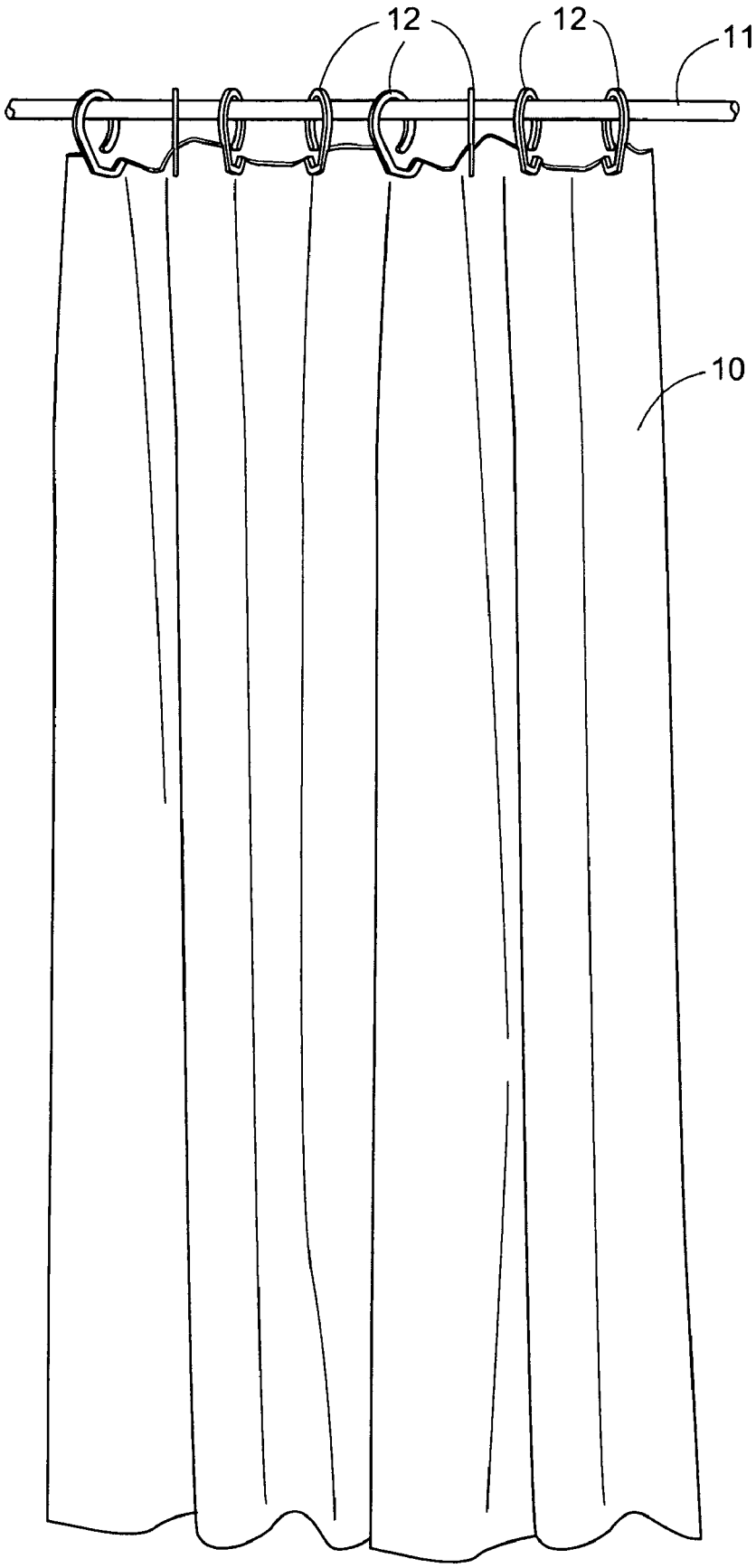
FIG. 1 illustrates a view of a shower curtain with integrated hooks suspended from a curtain rod in accordance with the invention.

Referring to FIG. 1, the shower curtain 10 is suspended from a curtain rod 11 by a plurality of hooks 12.

The shower curtain 10 is of any conventional material, such as, PVC, PEVA, EVA, polyester, nylon, cotton, and poly/cotton blends.

As illustrated, the curtain 10 is made of a single ply of material that is folded over on itself at the top edge and seamed together to form a top margin. In addition, a reinforcing strip (not shown) is positioned within the folded over top margin to stiffen the top margin. This reinforcing strip is made of a thin pliable plastic material, such as, PVC, PEVA, EVA, or could be a mesh like material made of polyester or nylon. The strip is of a width of from ½ inch to 1 inch and of a thickness of between 3 and 6 mil when placed on a curtain made of plastic. The purpose of the strip is to reinforce the top hem from tearing and to keep the top hem more in shape.

The curtain rod 11 may be of any suitable material and shape. For example, the curtain rod 11 is illustrated as being of circular cross-sectional shape. Further, the curtain rod 11 may be straight, i.e. rectilinear, or curved as is known.

Figure 2:
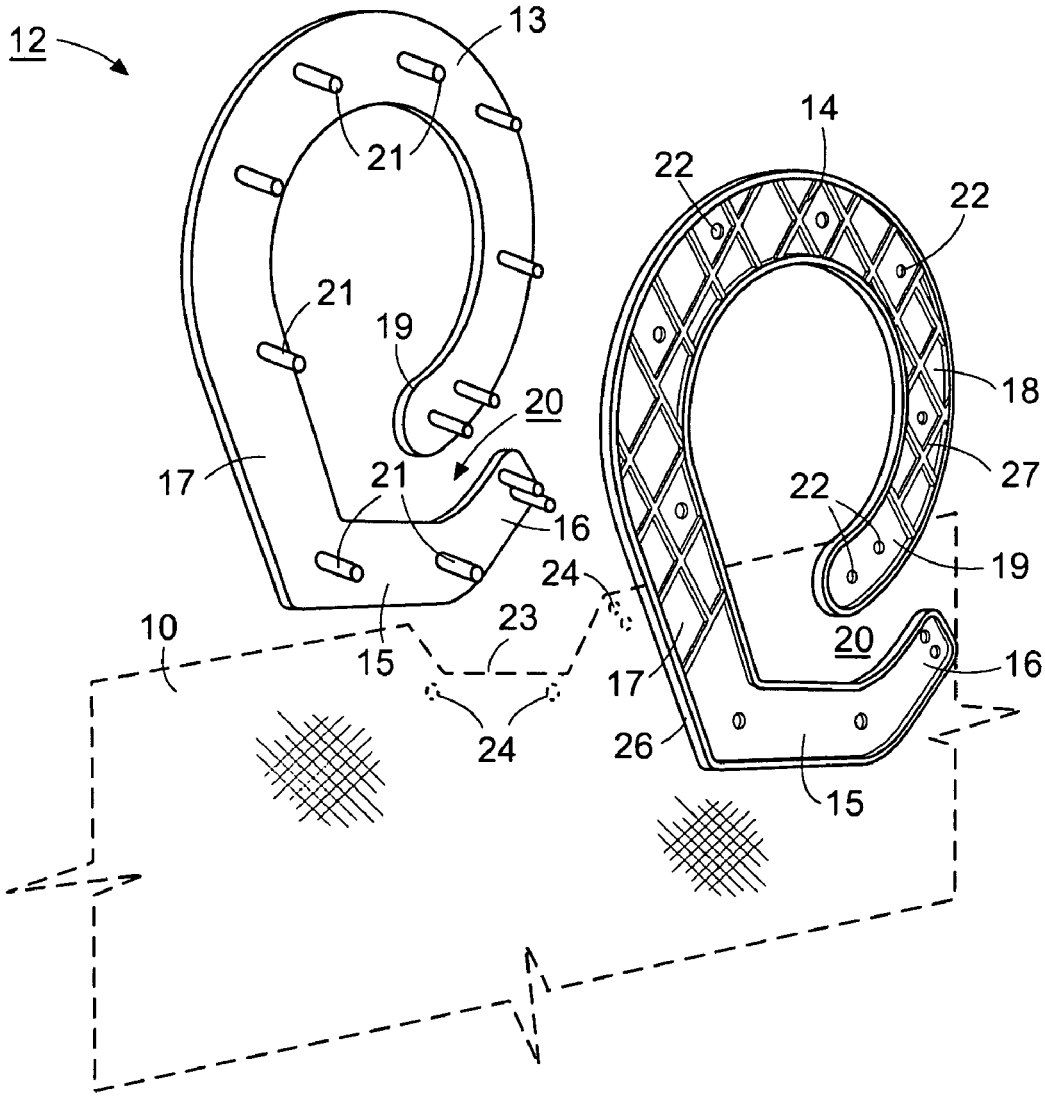
FIG. 2 illustrates an exploded view of a hook and a section of the curtain of FIG. 1.

Referring to FIG. 2, each hook 12 is formed of a pair of skeletal plastic bodies 13, 14 that are secured together in side-by-side relation so as to sandwich the curtain 10 therebetween.

As illustrated, each body 13, 14 has a rectilinear base 15, a first portion 16 that extends angularly from one end of the base 15 and a second portion 17 that extends from an opposite end of the base 15. In addition, each second portion 17 has a curvilinear section 18 that extends to a terminal section 19 at one end thereof that is disposed in spaced relation to the first portion 16 and the base 15 in order to define a gap 20 therebetween.

The curvilinear sections 18 of the hook 10 are shaped and are of a thickness to be resiliently pliable in order to allow the terminal sections 19 to be moved as a unit laterally of the first portions 16 and the bases 15 for passage of the rod 11 through the gaps 20 for mounting of the curtain 11 on the mounting rod 11 (see FIG. 1).

In order to secure the bodies 13,14 together, one body 13 of the hook 12 has a plurality of spaced apart posts 21 that are integrally mounted thereon while the other body 14 of the hook 12 has a plurality of openings 22 that are positioned and sized to receive a respective post 21 therein.

As illustrated in FIG. 2, the shower curtain 10 has a top margin that is provided with a plurality of longitudinally spaced apart recesses 23 and a plurality of holes 24 through which the posts 21 may pass.

During assembly, a hook body 13 is positioned at a recess 23 of the curtain 10 with the posts 21 of the base 15 and first portion 16 passing through respective holes 24 in the top margin of the curtain 11 and the reinforcing strip (not shown).

Thereafter, a hook body 14 is positioned so that the posts 21 of the body 13 pass into the openings 22 of the body 14. At this time, the terminal ends of the posts 21 are heat deformed and heat sealed in the respective openings 22. Alternatively, instead of using heat, the hooks could also be positioned with a pressure device that would accomplish the same result.

Figure 3:
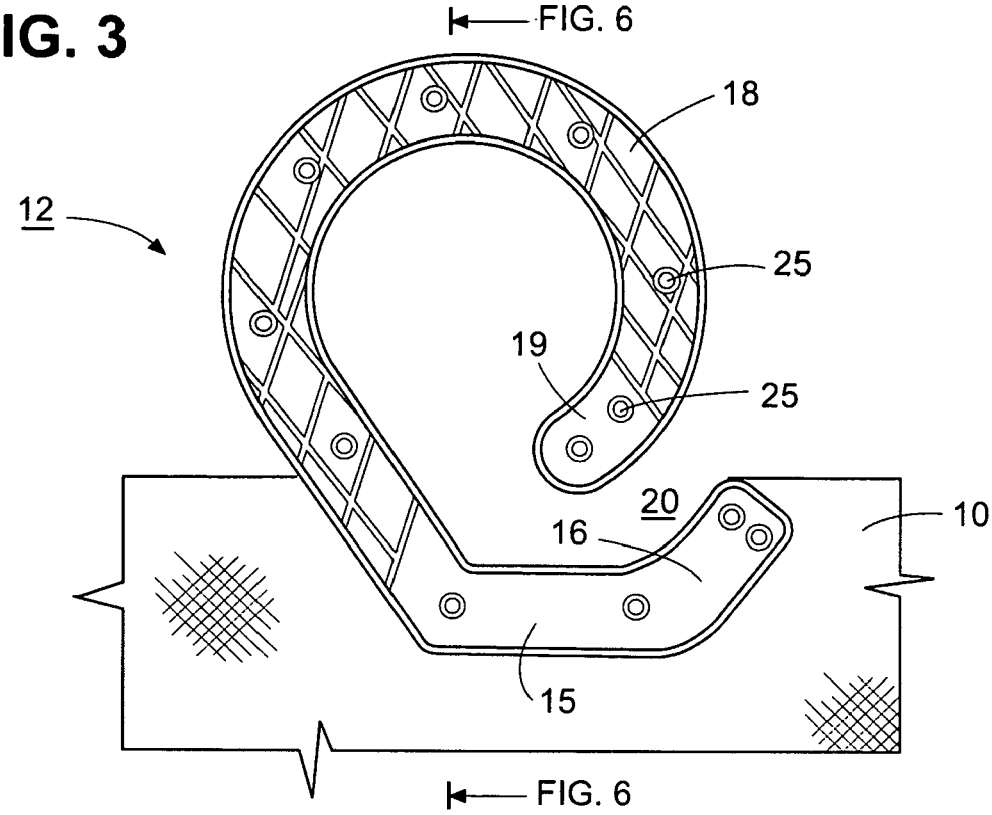
FIG. 3 illustrates a side view of the hook of FIG. 1 in place.
Figure 4:
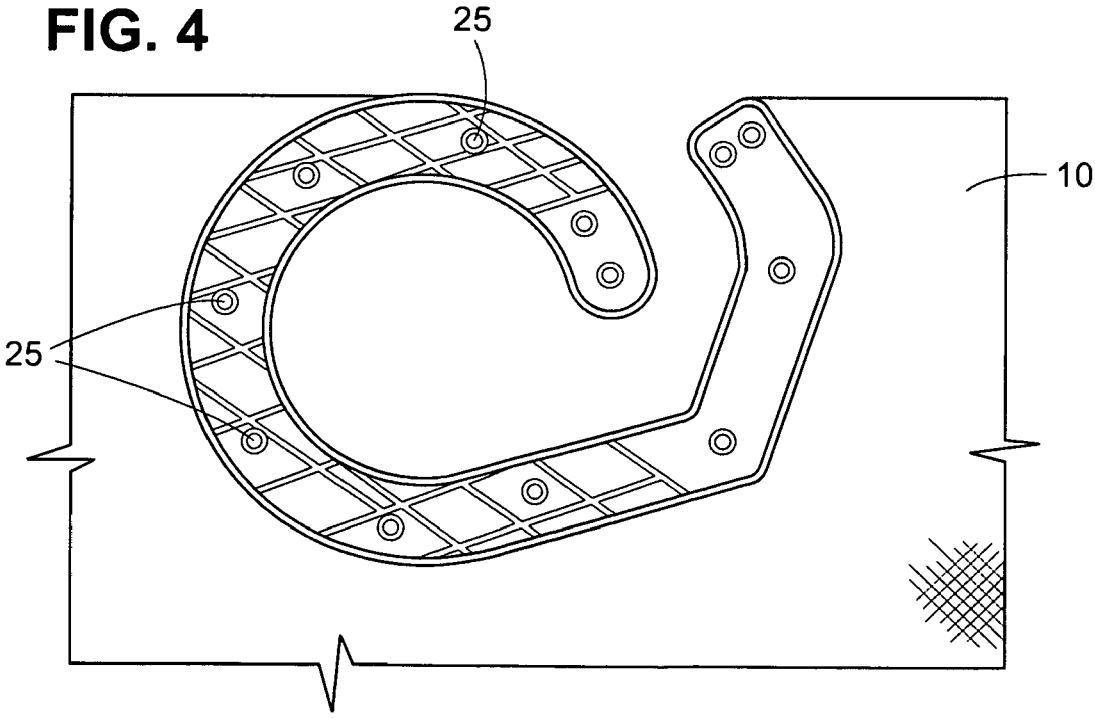
FIG. 4 illustrates a view of a modified use of the hook of FIG. 1 in accordance with the invention.

Referring to FIGS. 3 and 4, upon being heat deformed, each post 21 forms a head 25 in the manner of a rivet to permanently secure the two bodies 13, 14 together.

As shown in FIG. 3, the curvilinear sections 18 of the hook 12 have a circular cross-section in part so as to rest on the support rod 11 in a conventional manner. Further, the pliability of the curvilinear sections 18 is such that the terminal sections 19 may be moved laterally to enlarge the gap 20 between the terminal sections 19 and the angular portions 16 of the hook 12 to allow the hook 12 to pass over the curtain rod 11.

The hook 12 has an H-shaped cross-section with a peripheral flange 26 extending about the inner and outer peripheries. In addition, the base 15 and first angularly extending portion 16 have smooth surfaces while the curvilinear section 18 is provided with criss-crossing ribs 27 that serve to reinforce the hook 12 while imparting an aesthetic appearance.

As also shown in FIG. 3, when in place, each hook 12 is disposed in upstanding relation relative to top margin of the curtain 11 with the base 15 disposed in parallel to the top margin of the curtain 11. That is to say, as viewed in FIG. 3, the base 15 is disposed in a horizontal plane when the shower curtain 11 is suspended vertically.

Referring to FIG. 4, wherein like reference characters indicate like parts as above, the hook 12 may be disposed within the plane of the top margin of the curtain 11 with the base 15 disposed angularly of the top margin of the curtain.

Figure 5:
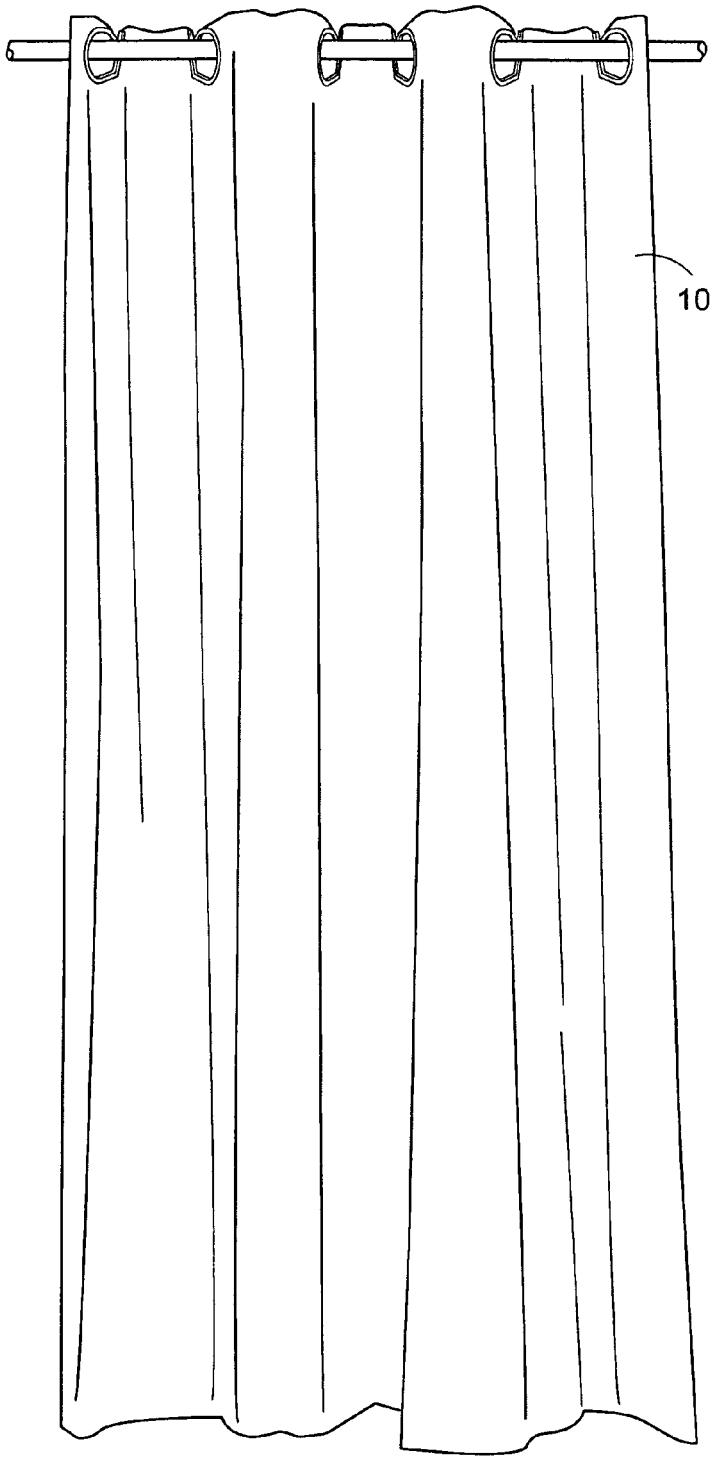
FIG. 5 illustrates a view of a shower curtain suspended from a curtain rod employing hooks having the orientation of FIG. 4.
Figure 6:
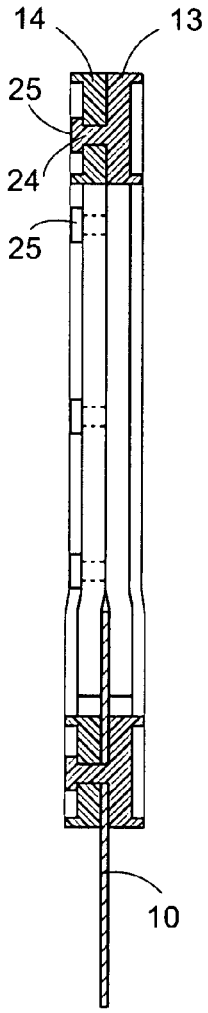
FIG. 6 illustrates a view taken on line 6-6 of FIG. 3.

Referring to FIG. 5, wherein like reference characters indicate like parts as above, the orientation of the hook 12 of FIG. 4 allows the plurality of hooks 12 to be "hidden" within the plane of the shower curtain 11, i.e. within the plane of the top margin of the curtain, when suspended from a curtain rod 11.

In either embodiment, the embodiment of FIG. 1 and the embodiment of FIG. 5, a shower curtain 10 may be readily moved along the curtain rod 11.

When one wishes to remove the shower curtain 10 from the curtain rod 11, the curvilinear sections 18 of each hook 12 are laterally deformed or twisted as a unit so as to allow removal of the hook from the curtain rod 11 by having the rod 11 pass through the thus enlarged gaps 20. In this way, all the hooks 12 may be easily and rapidly removed from the curtain rod 11.

The shower curtain 10 and hooks 12 may be cleaned or otherwise washed together as a unit and replaced on a curtain rod as a unit.

The surface appearance of the hook may be any suitable appearance for aesthetic reasons or to suit the needs of a customer.

What is claimed:

1. A hook for suspending a curtain comprising a pair of skeletal plastic bodies secured together in side-by-side relation;

each said body having a rectilinear base, a first portion extending angularly from one end of said base, a second portion extending from an opposite end of said base and having a terminal section at one end thereof disposed in spaced relation to said first portion and said base to define a gap therebetween.

2. A hook as set forth in claim 1 wherein one of said pair of skeletal plastic bodies has a plurality of spaced apart posts integrally mounted thereon and the other of said pair of skeletal plastic bodies has a plurality of openings, each said opening receiving a respective one of said posts therein in an integral manner.

3. A hook as set forth in claim 1 wherein said second portion has a curvilinear section for fitting about a mounting rod extending to said terminal section.

4. A hook as set forth in claim 3 wherein said curvilinear portion is resiliently pliable to allow said terminal section to be moved laterally of said first portion for passage over a mounting rod.

5. In combination, a curtain having a top margin including a plurality of longitudinally spaced apart recesses therein; and a plurality of hooks secured to said curtain for suspending said curtain from a mounting rod, each said hook being disposed in a respective one of said recesses of said curtain, each said hook including a pair of skeletal plastic bodies secured together in side-by-side relation to sandwich said curtain therebetween with each said body having a rectilinear base, a first portion extending angularly from one end of said base, a second portion extending from an opposite end of said base and having a terminal section at one end thereof disposed in spaced relation to said first portion and said base to define a gap therebetween.

6. The combination as set forth in claim 5 wherein each said hook is disposed in upstanding relation relative to said curtain with each said base disposed in parallel to said top margin of said curtain.

7. The combination as set forth in claim 5 wherein each said hook is disposed in within the plane of said top margin of said curtain with each said base disposed angularly of said top margin of said curtain.

8. The combination as set forth in claim 5 wherein one of said pair of skeletal plastic bodies of a respective one of said hooks has a plurality of openings and the other of said pair of skeletal plastic bodies has a plurality of spaced apart posts integrally mounted thereon and passing through said curtain into a respective one of said openings.

9. The combination as set forth in claim 8 wherein each of said posts is integrally joined to said other of said pair of skeletal plastic bodies.

10. The combination as set forth in claim 9 wherein said curtain has a plurality of holes, each said hole having a respective post of a respective hook passing therethrough.

11. The combination as set forth in claim 5 wherein said second portion of each said body of each said hook has a curvilinear section for fitting about a mounting rod extending to said terminal section.

12. The combination as set forth in claim 11 wherein each said curvilinear portion of each said body of each said hook is resiliently pliable to allow said terminal section to be moved laterally of said first portion for passage over a mounting rod.

13. The combination as set forth in claim 5 wherein each said hook is rigid and said terminal section and said first portion of each said hook define a gap larger than a mounting rod for passage thereover.

14. In combination, a curtain having a top margin including a plurality of longitudinally spaced apart recesses therein; and a plurality of hooks secured to said curtain for suspending said curtain from a mounting rod, each said hook being disposed in a respective one of said recesses of said curtain and including a rectilinear base, a first portion extending angularly from one end of said base, a second portion extending from an opposite end of said base and having a terminal section at one end thereof disposed in spaced relation to said first portion and said base to define a gap therebetween.

15. The combination as set forth in claim 14 wherein said second portion of each said body of each said hook has a curvilinear section for fitting about a mounting rod extending to said terminal section.

16. The combination as set forth in claim 15 wherein said curvilinear portion of each said hook is resiliently pliable to allow said terminal section to be moved laterally of said first portion for passage over a mounting rod.

17. The combination as set forth in claim 16 wherein each said hook is disposed in upstanding relation relative to said curtain with each said base disposed in parallel to said top margin of said curtain.

18. The combination as set forth in claim 16 wherein each said hook is disposed in within the plane of said top margin of said curtain with each said base disposed angularly of said top margin of said curtain.

* * * * *